US005767872A

United States Patent [19]

Scardovi et al.

[11] Patent Number: 5,767,872

[45] Date of Patent: Jun. 16, 1998

[54] INK JET PRINTHEAD THERMAL WORKING CONDITIONS STABILIZATION METHOD

[75] Inventors: Alessandro Scardovi, Ivrea; Vitantonio D'Amico, Turin, both of Italy

[73] Assignee: Olivetti-Canon Industriale S.p.A., Ivrea, Italy

[21] Appl. No.: 666,215

[22] Filed: Jun. 20, 1996

[30] Foreign Application Priority Data

Jul. 4, 1995 [IT] Italy ..... T095A0561

[51] Int. Cl.[6] ..... B41J 29/38

[52] U.S. Cl. ..... 347/17; 347/14

[58] Field of Search ..... 347/17, 19, 14

[56] References Cited

U.S. PATENT DOCUMENTS

| | | | |
|---|---|---|---|
| 4,567,353 | 1/1986 | Aiba | 219/501 |
| 5,208,611 | 5/1993 | Kappel et al. | 346/140 R |

FOREIGN PATENT DOCUMENTS

| | | | |
|---|---|---|---|
| 0443801 | 8/1991 | European Pat. Off. . | |
| 0641656 | 3/1995 | European Pat. Off. . | |
| 59-14969 | 1/1984 | Japan | 347/17 |
| 3-36035 | 2/1991 | Japan | 347/17 |
| 5-50590 | 3/1993 | Japan | 347/17 |

*Primary Examiner*—Edgar S. Burr
*Assistant Examiner*—Daniel J. Colilla
*Attorney, Agent, or Firm*—Banner & Witcoff, Ltd.

[57] ABSTRACT

An ink jet printhead comprising a plurality of ejection resistors and at least one additional resistor, integrated on the same semiconductor substrate; the additional resistor is constituted by a material with a positive coefficient of variation of resistance with temperature of between 0.3 and 1.0%/°C. and is used both for heating of the substrate and for measuring its temperature. Various circuits based on using the additional resistor are defined for implementing a method for stabilizing temperature of the substrate; also defined are a method for obtaining a stabilization temperature that remains constant with variation of the characteristics of the head and a method for setting the energetic operating point of the ejection resistors.

10 Claims, 4 Drawing Sheets

FIG. 2
(AMENDED)
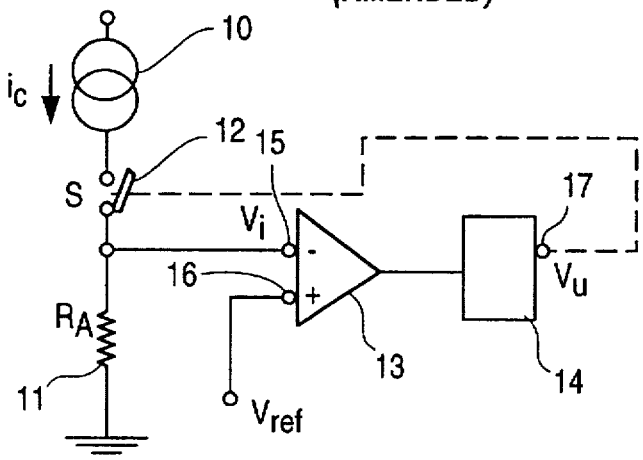

INK JET PRINTHEAD THERMAL WORKING CONDITIONS STABILIZATION METHOD

TEXT OF THE DESCRIPTION

1. Field of the Invention

The invention relates to a printhead used in equipment for forming black and colour images on a print medium, generally though not exclusively a sheet of paper, with the thermal ink jet technology and to a method of operation for stabilizing its thermal working conditions.

2. Related Technological Art

Equipment of the type described above is known in the art, such as for example printers, photocopiers, facsimile machines, etc., and especially printers used to print documents using printing means generally consisting of fixed or interchangeable printheads.

Composition and general mode of operation of an ink jet printer, as also of the associated ink jet printhead, are already well known in today's art, so that a detailed description shall not be provided herein but only a more comprehensive account of some characteristics of the heads of relevance to the understanding of this invention.

A typical ink jet printer schematically comprises:

- a system, selectively actuated by a motor, for feeding the sheet of paper on which the image is to be printed in such a way that the feeding occurs in a given direction in discrete steps (line feed),
- a movable carriage, running on ways in a direction perpendicular to the sheet feeding direction and selectively actuated by a motor so as to perform forward motion and return motion along the entire width of the sheet,
- printing means, generally, for example, a printhead removably attached to the carriage and comprising a plurality of ejection resistors, deposited on a substrate (usually a silicon wafer) and arranged inside cells filled with ink, each one connected to a corresponding plurality of nozzles through which the head is capable of ejecting droplets of ink contained in a reservoir,
- an electronic controller which, on the basis of information received from a "computer" to which it is connected and of presettings established by the user, selectively commands both the above motors and also the printhead, causing ejection from the latter of droplets of ink against the surface of the sheet, thereby forming a visible image, by means of selective heating of the resistors.

According to a recent evolution of the known technology, in addition to the ejection resistors, the printheads also comprise components for driving of the resistors, integrated on the same semiconductor substrate. Typically these components are integrated MOS transistors, i.e. produced by the known semiconductor integrated-circuit technology techniques on the same silicon substrate, and selectively supply the energy for heating of the ejection resistors.

From the electrical viewpoint, these integrated drive components, all with essentially the same geometrical and electrical characteristics, and the relative ejection resistors associated with them, are typically laid out in a matrix of rows and columns, according to methods of operation known in the art, in order to reduce to a minimum the number of connections and contacts between the printhead and the electronic controller.

The energy is supplied by the MOS transistors to the ejection resistors, by permitting flow through the resistors themselves of a current supplied by a power supply to which all the ejection resistors are connected. This current is converted into thermal energy by Joule effect in the ejection resistor, causing the latter to heat very rapidly to a temperature in the region of 300° C.

A first portion of this thermal energy is transferred to the surrounding ink in contact with the resistor, vaporising it and thus causing the ejection of a drop of determined volume through the nozzle connected to the cell housing the ejection resistor; a second portion of the thermal energy is lost by conduction through the common substrate (the silicon wafer) on which the ejection resistors are deposited, increasing the temperature $T_s$ of the substrate, of the head as a whole and of the ink it contains, with respect to the ambient temperature.

Incidentally, it must be noted that this rise in temperature may be confined to the surrounding region of a few only of the ejection resistors of the head, due to the fact that the current printing job may require preferential activation of some nozzles only, and the diffusion of heat by conduction in the substrate is not sufficiently rapid to obtain a uniform distribution of temperature.

The phenomenon of ejection of an ink droplet may be better understood when examined with reference to the graph in FIG. 1, illustrating the pattern measured experimentally and represented by a curve 3 of volume VOL of the ink droplet ejected by a nozzle in function of the thermal energy E supplied to the ejection resistor disposed in the cell connected to the nozzle, for a given, constant substrate temperature $T_s$.

As shown by the graph, under a value $E_s$ (threshold energy) the drop is not formed, since the resistor does not reach a temperature high enough to vaporise the surrounding ink. By increasing the energy E supplied to the resistor from value $E_s$ to value $E_g$ (knee energy), the volume VOL of the ejected droplets increases in a way substantially proportional to the increase in energy E supplied to the resistor. Conversely, above the $E_g$ value, the volume VOL remains substantially unchanged for increases of the energy E supplied to the resistor.

This asymptotic characteristic of the pattern of droplet volume VOL is extremely useful and is taken into consideration when defining the typical working value $E_l$ for the energy E to be supplied to the ejection resistor (energetic operating point). In actual fact, having a constant drop volume means that diameter of the elementary dot on the paper will be constant, as too therefore will density and uniformity of the images, whether black or colour. In other words, printing quality will be constant, a very important feature which is greatly appreciated by the users of printers.

Current practices adopt, for example, a compromise value for $E_l$, which is quite greater than $E_g$. This guarantees that limited fluctuations of the thermal energy E supplied to the ejection resistor due to various factors, such as drifts induced from production processes, or variations of the real operating conditions, do not entail significant variations of the volume VOL of ejected droplets. This is because of the fact that the energetic operating point of the ejection resistors is in any case inside the asymptotic portion of curve 3 and thus creation is avoided of the unstable operating conditions that could arise if $E_l$ were to drop below $E_g$ and droplet volume were to become variable.

It will therefore be clear that the temperature of a printhead is not constant during operation, but rather starts to increase when printing starts, at which point it is substantially similar to the ambient temperature. Subsequently it will fluctuate in function of the modes of printing adopted (for example, "draft" or "letter quality" modes), of the originals to be printed and of the work cycle.

It will also be clear that the lesser the fraction of thermal energy dispersed through the substrate, the lower said rise in temperature during printing will be.

As those skilled in the art of this sector know, the following problems occur on variation of head temperature:

volume of the droplets of ink ejected by the nozzles, for like values of working energy $E_i$, increases with the rise in temperature and causes, as illustrated earlier, a corresponding variation of the diameter of the elementary dots printed on the paper and a consequent degradation of printing uniformity. This phenomenon may be so apparent as to produce appreciable differences between the optical density of the characters printed at the start of a page and of those printed at the bottom of the same page, due to the increase in head temperature caused by printing of the page itself;

further, if temperature of the head reaches very high levels, a phenomenon of deposition of carbon residues may be instituted on some particular ejection resistors frequently activated during printing, due to decomposition of the ink on the resistor. Consequently, useful printhead life would be reduced, possibly even considerably, and failures of operation of the printhead would result due to failure of the nozzle concerned to eject ink.

To solve the problem of variation of droplet volume with printhead temperature variation, methods and devices have been suggested in the known art with the principal aim of stabilizing temperature $T_s$ of the substrate, in other words of having the head work at an essentially constant substrate temperature $T_s$.

For example, systems have been suggested for maintaining substrate temperature $T_s$ constant by slowing down the printing speed (and thus reducing the frequency at which droplets are ejected) when temperature $T_s$ tends to exceed a defined limit value in order to increase the time available for the head to cool naturally and settle at a lower temperature value, or also by stopping printing when temperature of the substrate exceeds a predetermined level. This however is detrimental to the work performance speed (or "throughput"), a requirement rated ever more highly by the users of ink jet printers.

Further, systems have been suggested for maintaining the substrate temperature $T_s$ constant so that the head works permanently at a maximum predetermined temperature level by using, for example, either additional resistors as well as the ejection resistors to heat the head as necessary, or the ejection resistors themselves to heat the head. In the latter case, the ejection resistors of those nozzles that are not required to eject ink drops are still heated, but with energy pulses of a frequency that is too high to produce ejection of a droplet. However, both these solutions require the head to be fitted with a temperature sensor, for example a thermistor mounted in contact with the head, making construction of the head more complex and increasing the associated costs.

All the suggested solutions known in the art, as seen above, have drawbacks, so that the problem of simply, effectively and inexpensively stabilizing the thermal working conditions of an ink jet printhead has still not been resolved satisfactorily.

Nor do they resolve the problem of carbon residue deposits on certain ejection resistors as stabilization is produced at very high temperature values.

SUMMARY OF THE INVENTION

It is a principal object of the present invention to define an ink jet printhead comprising ejection resistors integrated on a semiconductor substrate and provided with temperature stabilizing means, wherein said stabilizing means include an additional resistor for heating the substrate which simultaneously acts as a substrate temperature measuring element.

A further object of this invention is that of stabilizing the thermal working conditions of an ink jet printhead comprising a semiconductor substrate on which are integrated ejection resistors and an additional resistor for stabilizing temperature of the substrate, wherein said additional resistor is also used as a substrate temperature measuring element.

Another object of this invention is that of defining a method for stabilizing the thermal working conditions of an ink jet printhead comprising resistors for ejection of droplets of ink integrated on a semiconductor substrate, wherein substrate temperature can be stabilized at different predetermined values.

A further object of this invention is that of defining a method for stabilizing the thermal working conditions of an ink jet printhead comprising resistors for ejection of droplets of ink integrated on a semiconductor substrate, wherein variation of the substrate temperature from the stabilization value may be confined to within predetermined values.

Yet a further object of this invention is that of defining a method for stabilizing the thermal working conditions of an ink jet printhead comprising a semiconductor substrate on which are integrated ejection resistors and an additional resistor for stabilizing temperature of the substrate, wherein the temperature value at which to stabilize the head is maintained constant, in spite of variability of the specific characteristics of the head used.

A yet further object of this invention is that of defining a method for stabilizing the thermal working conditions of an ink jet printhead comprising a semiconductor substrate on which are integrated ejection resistors and an additional resistor for stabilizing temperature of the substrate, wherein the energetic operating point of the ejection resistors is made vary in function of temperature of the substrate in order to minimize heating of the substrate itself.

Yet a further object of this invention is that of defining a method for stabilizing the thermal working conditions of an ink jet printhead comprising a semiconductor substrate on which are integrated ejection resistors and an additional resistor for stabilizing temperature of the substrate, wherein the energetic operating point of the ejection resistors is optimized as regards the thermal equilibrium and operating consistency in function of the specific characteristics of the head used.

The above objects are achieved by means of a method for stabilizing the thermal working conditions of an ink jet printhead and the associated printhead, characterized according to the main claims.

These and other objects, characteristics and advantages of the invention will become more apparent upon consideration of the following description of a preferred embodiment, provided by way of a non-exhaustive example, in conjunction with the accompanying drawings.

BRIEF DESCRIPTION OF THE DRAWINGS

FIG. 2—Represents an electric diagram of the printhead temperature stabilization circuit according to a first, preferred embodiment of the invention.

DETAILED DESCRIPTION OF THE PREFERRED EMBODIMENT

Figure 1:
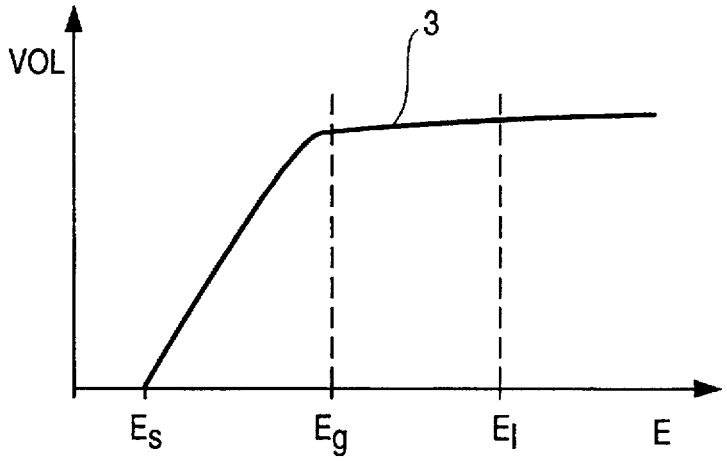
FIG. 1—Represents a graph of the pattern of droplet volume in function of the energy supplied to the corresponding ejection resistor.

The ink jet printhead according to the present invention possesses, in addition to the ejection resistors, an additional resistor 11 (see FIG. 2), produced on the same semiconductor substrate by means of deposition of a film, generally of aluminium (but possibly also of copper or of a copper/aluminium alloy), using for this purpose one of the steps of the normal printhead construction process. In the known art, the ejection resistor connecting conductors are generally produced from aluminium, copper or an aluminium/copper alloy, whereas the ejection resistors themselves are usually produced from tantalum/aluminium or from hafnium boride.

The additional resistor 11 may be provided as a ribbon, of predetermined constant thickness and width, arranged along the perimeter of the substrate and possibly provided with serpentine areas in ways well known in the art in order to increase its overall length so as to present, at its ends connected to two electrodes, a resistance value which, when appropriately supplied, is capable of dissipating an electric power of between, for example, 1 and 10 Watts, preferably of about 5 Watts.

As is known, the coefficient of variation of the resistance of aluminium, copper or copper/aluminium alloys with temperature is positive and comparatively high, i.e. between 0.3 and 1.0%/°C.; on the other hand, tantalum/aluminium has a coefficient of variation of resistance with temperature that is negative and comparatively low, i.e. of about 0.017%/°C., whereas the coefficient of hafnium boride is substantially null.

Selection of aluminium, copper or copper/aluminium alloys as the material for the additional resistor 11 is explained by the fact that it can be used as it is both for heating of the substrate, through Joule effect on a current caused to flow through the resistor itself; and also as a means of detecting the substrate temperature $T_s$, using the variations in its resistance on variation of temperature to do so. It is arranged in such a way geometrically that enables it to measure average temperature for the whole substrate with a good degree of accuracy.

FIG. 2 represents the electrical circuit used, according to a first embodiment of the present invention, to stabilize substrate temperature $T_s$; notice that, while the additional resistor 11 necessarily forms part of the head (or better, of the circuit integrated on the substrate), all other devices or electronic components shown in FIG. 2 may either form part of the same head, or form part of the printers electronic controller, without in any way affecting operation of the circuit but simply representing the most convenient option as based on technological and economic considerations.

Indicated 10 in the circuit of FIG. 2 is a current generator of a constant current $i_c$; in the same figure, $R_A$ indicates the resistance value of additional resistor 11, S indicates a switch 12 (electronic, electromechanical or mechanical), 13 a differential amplifier and 14 a monostable univibrator. All these electronic components and devices are well known in the art and a detailed description will not be provided herein.

Figure 3A:
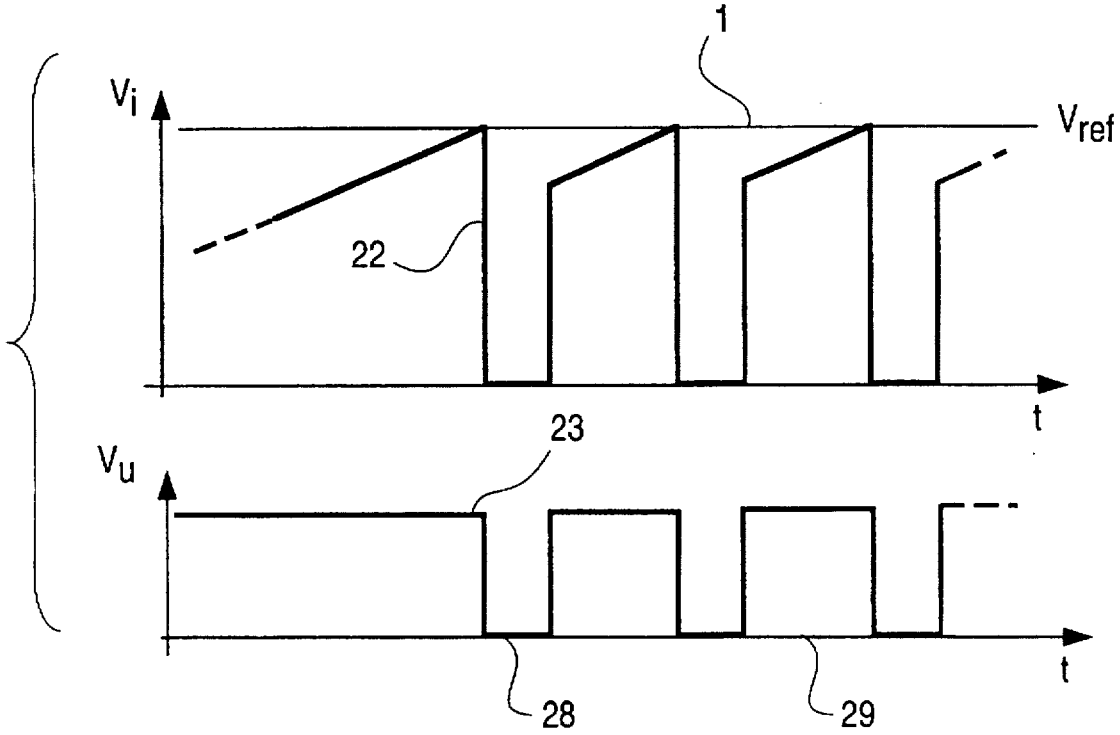
FIG. 3*a*—Represents a graph of the pattern of the voltages $V_i$ and $V_u$ in the circuit of FIG. 1 in function of time during a head non-printing period, for the circuit of FIG. 2.

The method of operation of the circuit represented in FIG. 2, in the condition in which the printhead is in service but is not printing, is illustrated in the following with reference to FIG. 3a. Initially the voltage $V_u$ (represented by curve 23) on one output 17 of univibrator 14 is "high", thus keeping switch 12 closed (the terms "high" and "low" are used herein in their recognized logic circuit description meanings) and allowing the constant current $i_c$ to flow through additional resistor 11. Current $i_c$ flowing in additional resistor 11 generates a voltage drop $V_i$ (represented by curve 22) across its terminals and also heats the substrate, through Joule effect, causing temperature $T_s$ to rise.

The differential amplifier 13 compares the value $V_i$ of the voltage drop on the terminals of the resistor 11, brought to one of its negative inputs 15, with a reference voltage $V_{ref}$ (represented by the dashed line 1), selected in function of the head stabilization temperature desired, present on one of its positive inputs 16. Initially $V_i$ is lower than $V_{ref}$, and differential amplifier 13 keeps univibrator 14 blocked so that its output 17 remains "high"; but as substrate temperature $T_s$ increases due to the heat induced from additional resistor 11, resistance value $R_A$ of resistor 11 increases and accordingly $V_i$ also increases until when $V_i=V_{ref}$ and differential amplifier 13 triggers univibrator 14.

In this way, the output of univibrator 14 goes "low", thereby commanding switch 12 to open for a determined time $t_{off}$ 28, which is characteristic of univibrator 14, and interrupting the flow of current $i_c$ through the additional resistor 11 and the resulting substrate heating effect.

At the end of time $t_{off}$ 28, as value $V_i$ of the voltage drop across the terminals of resistor 11 has in the meantime again become lower than $V_{ref}$, the reference voltage value, due to natural cooling of the substrate and of the additional resistor 11 with the resultant drop in resistance value $R_A$, differential amplifier 13 again stops univibrator 14, so that switch 12 closes again and a new substrate heating cycle starts for a time ton 29. Represented in FIG. 3a are waveforms 22 and 23 of voltages $V_i$ and $V_u$ respectively in function of time, which illustrate the repeated sequence of opening and closing cycles of switch S, by means of which temperature $T_s$ of the substrate, and therefore that of the printhead, is maintained substantially constant under steady operating conditions and which have substantially constant corresponding times, $t_{on}$ 29 and $t_{off}$ 28.

The stabilization value of substrate temperature $T_s$ is determined from the reference voltage $V_{ref}$ value, this value being defined at a level capable of ensuring proper printhead operation, both in terms of printing quality and of reliability.

Figure 3B:
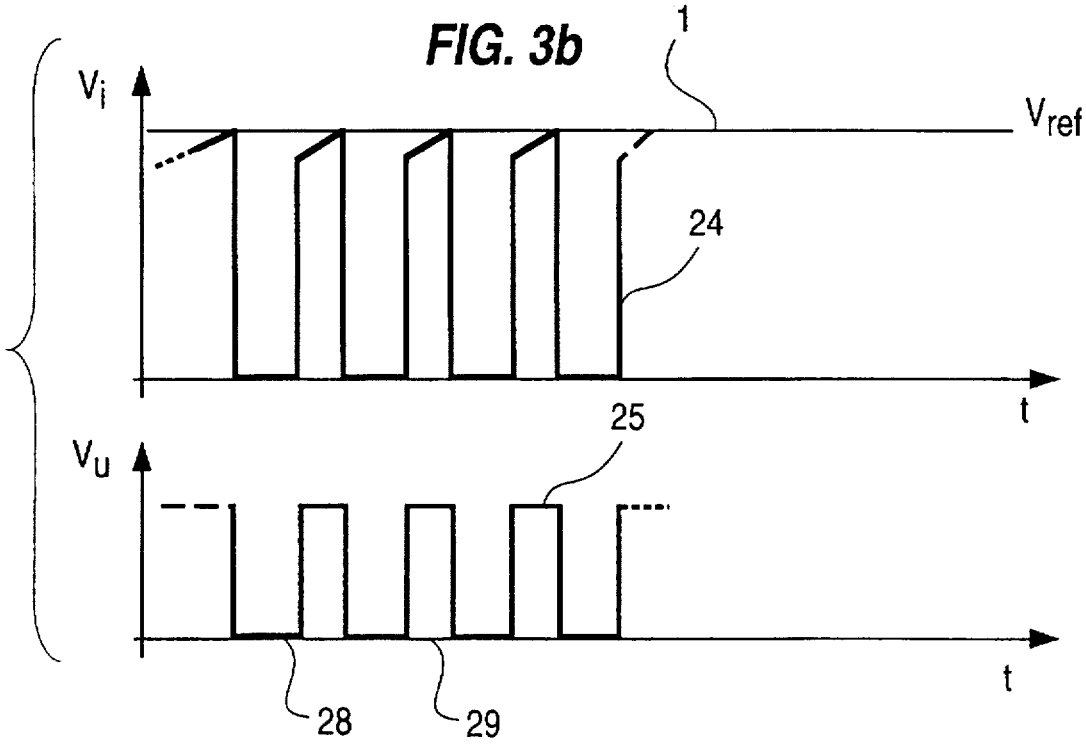
FIG. 3b—Represents a graph of the pattern of the voltages $V_i$ and $V_u$ in the circuit of FIG. 1 in function of time during a head printing period, for the circuit of FIG. 2.

Let us examine the situation in which, having reached the steady temperature conditions when not printing according to the method of operation described earlier, printing is effected by making the printhead work, that is to say by ejecting drops of ink from the nozzles following selective heating of the ejection resistor; under these conditions, the method of operation of the circuit represented in FIG. 2 is described below, with reference also to FIG. 3*b*.

The energy supplied to the resistors, in excess of the amount needed to form and eject a drop, in turn results in heating of the substrate which is summed with the heating caused by the additional resistor 11. This duly shortens time $t_{on}$ 29 during which current ic flows through resistor 11, but does not alter $t_{off}$ 28 which is determined solely from the characteristics of univibrator 14 and is selected in function of the maximum permitted variation (known as "ripple") for the steady condition substrate temperature value $T_s$, taking into consideration the printhead's thermal time constant. The maximum permitted variation for temperature $T_s$ under steady conditions may be contained to within sufficiently low values as to be considered of negligible effect on overall thermal behaviour of the printhead. For example, the circuit of FIG. 2 may be suitably sized as to give maximum variations of temperature $T_s$ of approximately 1° C.

In other words, during printing the additional resistor 11 supplies the substrate the amount of heat needed to reach the steady condition temperature, in addition to the amount supplied to the ejection resistors. Represented in FIG. 3*b* are the waveforms 24 and 25 of voltages $V_i$ and $V_u$ respectively in function of time while printing is taking place, illustrating the repeated sequence of opening and closing cycles of switch 12, which permit substrate temperature $T_s$ to be maintained substantially constant under steady conditions during printing work.

Figure 4:
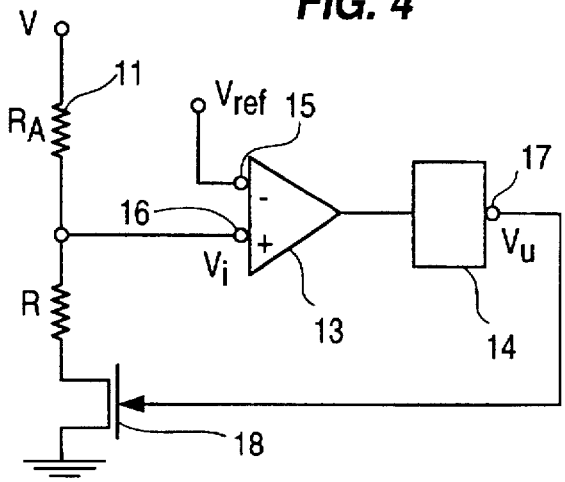
FIG. 4—Represents an electric diagram of the printhead temperature stabilization circuit according to a second embodiment of the invention.

FIG. 4 represents the electric circuit used, according to a second embodiment of the present invention, to stabilize substrate temperature $T_s$; the numbering scheme used is the same as that of FIG. 2 for like devices. Voltage $V_i$ on positive input 16 of differential amplifier 13 is obtained from a supply voltage V through a voltage divider formed by additional resistor 11 and a second resistor 19, connected to ground through a transistor 18, of the MOS type for example, driven by voltage $V_u$ on the output 17 of univibrator 14. Transistor 18 has the same function as switch 12 in FIG. 2, permitting current to flow in additional resistor 11 only when voltage $V_u$ on output 17 of univibrator 14 is "high".

The second resistor 19, of a resistance R, is comprised of a resistor deposited on the substrate, independently from the ejection resistor, but of the same composition as the latter, that is they are produced by the deposition of a film of aluminium/tantalum or of hafnium boride. Accordingly it possesses considerable stability in relation to temperature fluctuations. When transistor 18 conducts, second resistor 19 also contributes to heating of the substrate, thereby increasing the system's speed of response and decreasing stabilization time of temperature $T_s$.

Figure 5:
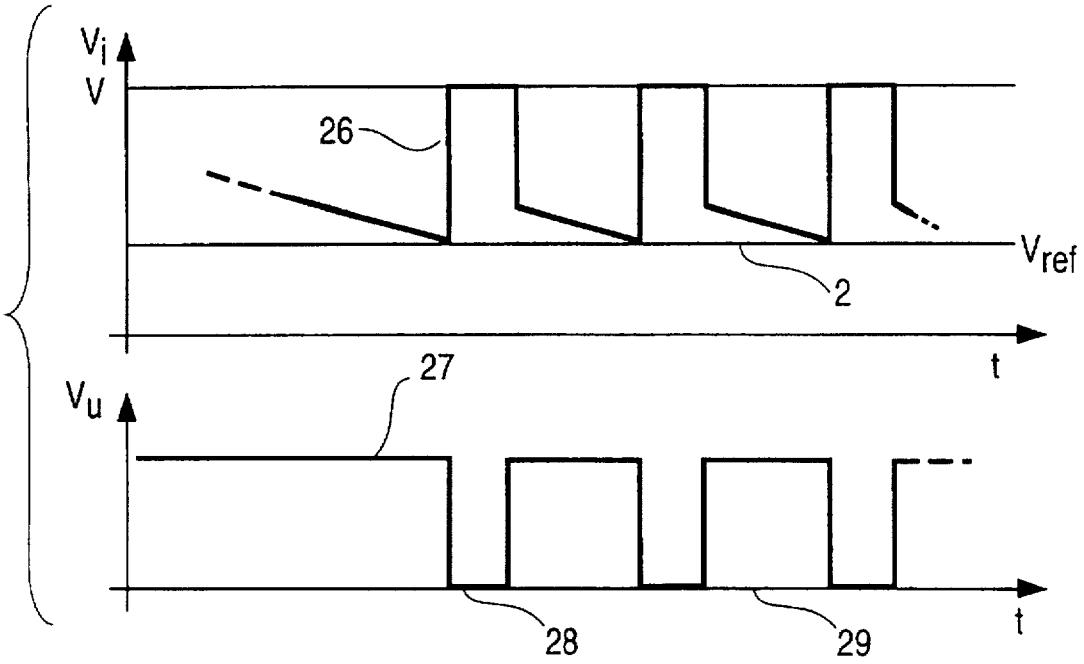
FIG. 5—Represents a graph of the pattern of the voltages $V_i$ and $V_u$ in the circuit of FIG. 3 in function of time during a head non-printing period, for the circuit of FIG. 4.

Method of operation of the circuit of FIG. 4 is substantially similar to that described in the foregoing for the circuit of FIG. 2; for the sake of brevity, however, a detailed described will be only provided for the case in which printing is not taking place, with reference to FIG. 5, wherein the waveforms of voltages $V_i$ and $V_u$ are represented respectively by curves 26 and 27.

Initially when transistor 18 conducts, the additional resistor 11, having a resistance RA, has a current flowing through it of $$i=V/(R_A+R) \quad (1)$$

(leaving aside the conduction channel resistance of transistor 18), and the value of voltage $V_i$ at input 16 of differential amplifier 13 is given by $$V_i=V\,R/(R_A R); \quad (2)$$

when transistor 18 is not conducting, $V_i$ substantially coincides with V.

As temperature $T_s$ of the substrate rises, by effect of the heating caused by the current i through both resistor 11 and resistor 19, resistance $R_A$ of the additional resistor 11 increases and, as a result, voltage $V_i$ decreases.

When value of voltage $V_i$ reaches a point where it is equal to the reference voltage $V_{ref}$ (represented by dashed line 2) at input 15 of the differential amplifier 13, differential amplifier 13 triggers univibrator 14; in this way, output 17 of univibrator 14 becomes "low", thereby commanding transistor 18 to stop conducting for a predetermined time $t_{off}$ 28, which is characteristic of the univibrator, and interrupting the flow of current i through additional resistor 11 and second resistor 19 and the resulting substrate heating effect.

At the end of time $t_{off}$ 28, as the value of voltage $V_i$ has again become greater than the $V_{ref}$ reference voltage value, due to natural cooling of the substrate and of resistors 11 and 19 with the resultant decrease in resistance $R_A$ of resistor 11, the differential amplifier 13 again stops univibrator 14, allowing transistor 18 to conduct and a new substrate heating cycle to start for a time $t_{on}$ 29. Represented in FIG. 4 are the waveforms 26 and 27 of voltages $V_i$ and $V_u$ respectively in function of time, illustrating the repeated sequence of these transistor 18 conduction and interruption cycles, by means of which temperature $T_s$ of the substrate, and therefore that of the printhead, is maintained substantially constant under steady conditions of operation and for which the corresponding times, $t_{on}$ 29 and $t_{off}$ 28, are substantially constant.

Figure 6:
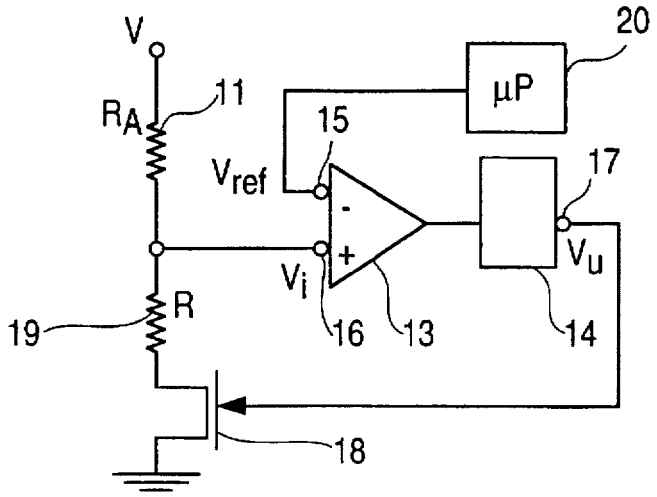
FIG. 6—Represents an electric diagram of the printhead temperature stabilization circuit according to a third embodiment of the invention.

FIG. 6 represents the electric circuit used, according to a third embodiment of the present invention, to stabilize substrate temperature $T_s$; it differs from the one illustrated above in that the reference voltage $V_{ref}$ at input 15 of differential amplifier 13 is not constant, but rather is determined by a microprocessor 20, preferably external to the printhead and forming part of the printer's electronic controller.

This third embodiment is may be used to meet the requirement of defining different printhead working temperatures, dictated by particular printhead working conditions, for example: changes in droplet ejection frequency and therefore of printing speed, or changes in the printing density of the elementary dots with the resultant need to change droplet volume and hence diameter of the elementary dot. Operation of the circuit of FIG. 6 is fully similar to that already described for the circuit of FIG. 4 and does not therefore require a dedicated illustration.

Figure 7:
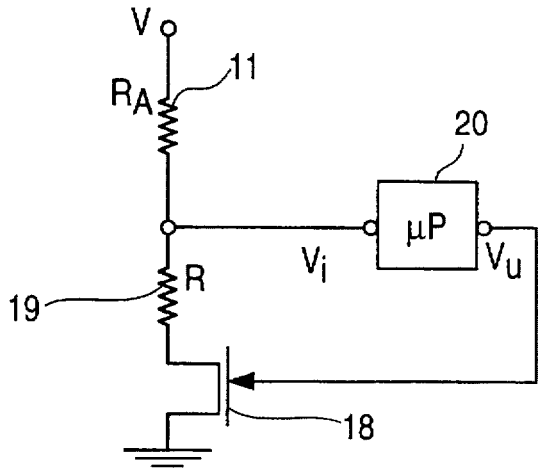
FIG. 7—Represents an electric diagram of the printhead temperature stabilization circuit according to a fourth embodiment of the invention.

FIG. 7 represents the electric circuit used, according to a fourth embodiment of the present invention, to stabilize substrate temperature $T_s$; it differs from those illustrated in the foregoing in that the functions performed by differential amplifier 13 and by univibrator 14 are here all performed by microprocessor 20, using its own internal functionalities according to methods known in the art. General method of operation of the circuit of FIG. 7 is unchanged, with regard to that already described for the circuit of FIG. 4, and therefore a specific account will not be given herein.

To return now to the circuit of FIG. 4 (but similar considerations are also applicable to the other circuits of FIGS. 6 and 7 already described), a particular aspect of resistors 11 and 19 must be emphasized: their resistance values $R_A$ and R are the result of a series of factors linked to the materials used and the production process employed to construct them, as a result of which possibly even non-negligible variations of said resistance values $R_A$ and R may arise in industrial practice, due to the manufacturing tolerances and the materials used.

The spread of resistance values $R_A$ and R in different printheads, in function of the equation (2) seen above, for like substrate temperature conditions, results in a different value of $V_i$ when transistor 18 conducts. This difference in values of voltage Vi would result in stabilization of substrate temperature $T_s$ at values possibly even considerably different from head to head. Selection of the heads produced might then become a necessity, with rejection of one part of them and creating problems of costs and production capacity.

This selection may be avoided starting from the consideration that, if the reference voltage $V_{ref}$ is adapted head by head to the actual specific value of resistance $R_A$ and R, then it is possible to compensate automatically for dispersion in the range of $V_i$ values and thus obtain a substantially uniform stabilization value for temperature $T_s$ on any head, regardless of the range of resistance values $R_A$ and R. The circuits of FIGS. 6 and 7 are suitable, with a minor variation, for achieving a method that permits this adaptation.

Figure 8:
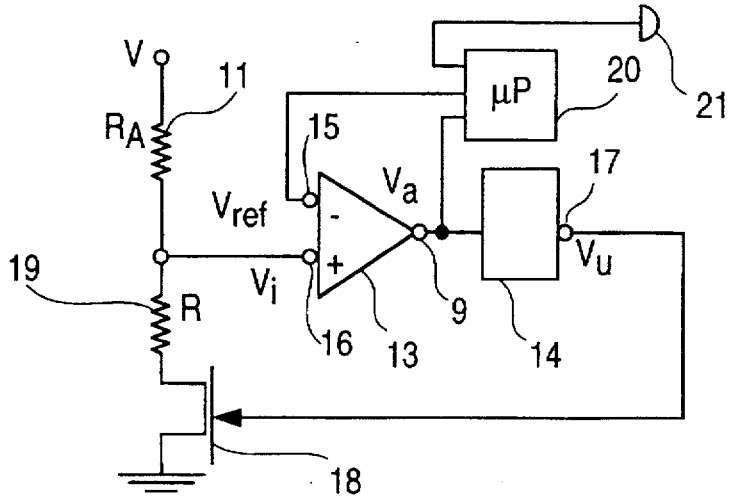
FIG. 8—Represents an electric diagram of the printhead temperature stabilization circuit according to a fifth embodiment of the invention.

Adaptation of the $V_{ref}$ value to the specific characteristics of the printhead fitted in the printer may be obtained from a fifth embodiment of the present invention as represented by the circuit of FIG. 8, in which microprocessor 20 also controls a value $V_a$ of output 9 of differential amplifier 13. This circuit makes it possible to use microprocessor 20 to automatically perform, head by head, setting of the reference voltage value $V_{ref}$ in function of the actual values of $R_A$ and R, where the flow of operations is as follows:

when the printer is switched on or when the head fitted in the printer is changed, microprocessor 20 sets a value $V_{ref0}$ for the reference voltage that is higher than the maximum value that voltage $V_i$ can reach when transistor 18 conducts, but which is lower than V; the $V_i$ maximum value is determined from the printhead's maximum permitted operating temperature and from the widest range of manufacturing tolerances for resistance values $R_A$ and R, and of the voltage V supplying the resistive divider comprised of resistors 11 and 19. Under these conditions (namely with a voltage $V_i$ on positive input 16 of differential amplifier 13 still lower than the $V_{ref0}$ voltage on negative input 15 when univibrator 14 is stopped and transistor 18 is conducting), the circuit of FIG. 8 is unstable and univibrator 14 generates a sequence of pulses of duration $t_{off}$, without interruption but with a period time of ton/min that corresponds to the time required to propagate the electric signal through the chain formed by differential amplifier 13, univibrator 14, and transistor 18;

subsequently the reference voltage $V_{ref}$ is gradually decreased until a value $V_{ref1}$ is reached at which time $t_{on}$ starts to rise with respect to the minimum value $t_{on/min}$ described earlier, and this precisely at the point when the specific $V_i$ value for that head is greater than $V_{ref1}$, when transistor 18 conducts.

The value Vref1 is assumed by the microprocessor μP as the reference voltage setting for that particular head; if the printer is additionally provided with an ambient temperature measuring means 21, the $V_{ref1}$ setting value may be set in relation with the ambient temperature, so that microprocessor 20, with a simple internal procedure readily definable by those skilled in the sector art, is capable of calculating the specific setting value $V_{ref1}$ to be adopted for each printhead, regardless of the ambient temperature.

Practical applications indicate taking the $V_{ref1}$ value, or preferably a value slightly lower than this but still determined by microprocessor 20, for use as the actual value for $V_{ref}$ so that the system is compelled to stabilize at the desired temperature value.

The circuit illustrated in FIG. 8 is also suitable, again by exploiting the processing capability of microprocessor 20, for providing a further positive effect capable of solving the already mentioned problem of supplying the ejection resistors the minimum energy needed for ejecting stable volume droplets.

In other words, the circuit of FIG. 8 may be used to define a method of identifying a sufficiently approximated value for knee energy $E_g$ (FIG. 1) characteristic of any printhead, and therefore of determining a value for energy $E_1$ (energetic operating point) greater than $E_g$ by an amount which, on the one hand, is sufficient to ensure that not too much energy is supplied to the ejection resistors, so as not to contribute excessively to heating of the substrate and thus be obliged to stabilize head temperature at too high a value, with the risk of impairing durability of the ejection resistors. On the other hand, this amount also eliminates the risk of having to work in the area of the curve 3 of FIG. 1 wherein the volume of the drops ejected varies with the energy and droplet ejection itself may become random.

Figure 9:
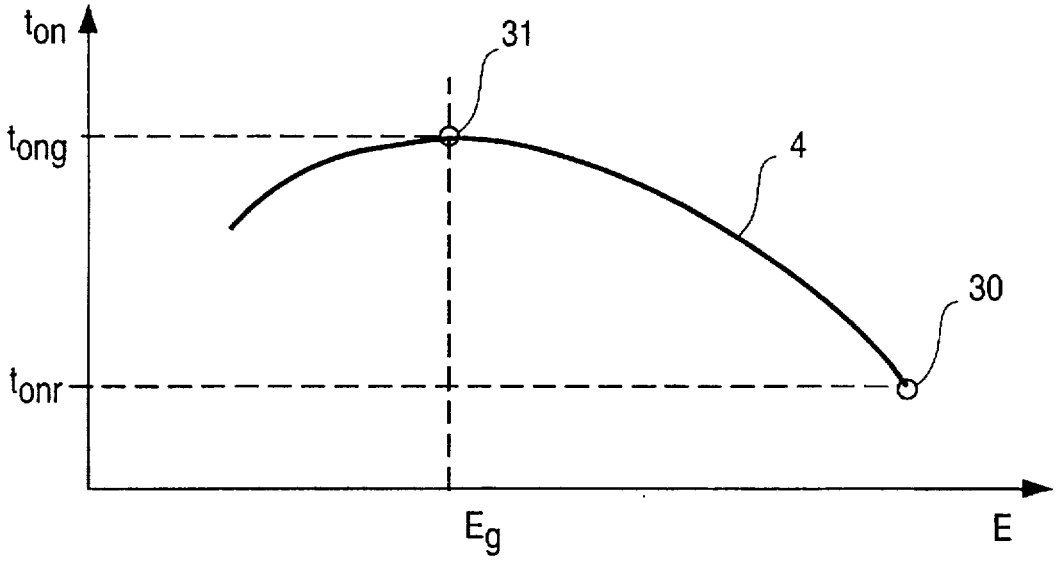
FIG. 9—Represents a graph of the pattern of the time ton in which energy is supplied to the additional resistor for heating of the substrate in function of the working energy supplied to the ejection resistors, for the circuit of FIG. 8.

This positive effect is obtained from the following method of operation applied to the circuit of FIG. 8 and illustrated with reference to curve 4 illustrated in FIG. 9, representing approximately and in graphic form the pattern of the conduction time ton of transistor 18 when plotted against the energy E supplied to the ejection resistors:

once thermal stabilization of the head has been obtained when not printing, printing is simulated by supplying all the ejection resistors an energy E greatly in excess of $E_g$ (FIG. 1): this may be done, for example, by altering the time during which voltage is applied to their terminals through the driving transistors. As a result of the considerable quantity of heat created for the substrate by the ejection resistors, time $t_{on}$ during which transistor 18 conducts will decrease considerably. This value is assumed as the reference value $t_{onr}$ (point 30 of FIG. 9);

the amount of energy E supplied to the ejection resistors is then reduced gradually, for example by acting on the driving transistors to reduce the time for which voltage is applied to said resistors: the temperature stabilization circuit responds to the reduced amount of heat created for the substrate by the ejection resistors by gradually increasing transistor 18 conduction time $t_{on}$ from the reference value $t_{onr}$;

as the amount of energy E supplied to the ejection resistors continues to be reduced, a point is reached at which said energy is lower than the knee energy $E_g$ (FIG. 1); under these conditions, on entering the unstable droplet ejection operating area, the reduced volume of droplets ejected and random nature of the ejection causes a fresh rise in the amount of heat created for the substrate by the ejection resistors, due to the increase in that portion of energy supplied to the ejection resistors which does not produce droplet ejection, but instead increases temperature of the substrate. Accordingly conduction time ton of transistor 18 stops increasing and starts to decrease, as a lesser contribution is required of the circuit of FIG. 8 for maintaining head temperature at a constant value. This inversion in variation of time $t_{on}$ gives a maximum value $t_{ong}$, represented by point 31 of curve 4.

The value of working energy supplied to the ejection resistors corresponding to value $t_{ong}$ of the time for which voltage is applied, through the action of the driving transistors, to the terminals of the ejection resistors, in turn corresponding to this maximum point 31, substantially represents value-of knee energy $E_g$. Once the $E_g$ value has been identified for a given head and a given ambient temperature, the microprocessor 20 of the circuit in FIG. 8 is capable of setting (through internal procedures readily definable by those skilled in the sector art) the optimum value $E_l$ and a $V_{ref}$ value suitable for stabilizing temperature of the head at the minimum acceptable level.

The optimum value of $E_l$ may be greater than $E_g$ by a given amount, equivalent to a predetermined percentage of $E_g$ itself, for example an amount of between 2 and 50% of the value identified for $E_g$, and preferably 5% of $E_g$.

Naturally the process described in the foregoing for identifying the $E_g$ value (and resultant determination of the optimum value for $E_l$) may be effected each time the printhead is replaced, or even each time that the printer in which the head is fitted is switched on, or at any other time at which microprocessor 20 is programmed to effect it.

Those skilled in the art of this sector may easily identify variants or changes to the ink jet printhead and method of operation described above, without exiting from the scope of this invention.

For example, a printhead with a different scale of component integration may be used, one for example comprising not only the MOS drive transistors, but also logic type circuits (shift registers, decoders, etc.).

Furthermore, the printhead may be of the removable type, fitted on a carriage that runs across the entire width of the sheet of paper that is being printed on, or of the fixed type capable of ejecting droplets of ink along the entire width of the sheet (line head).

It is also possible, for example, to use printheads for black and for colour printing, in which the ink reservoirs, instead of being integrated in the head (the type of printhead known as "monobloc"), are removable and replaceable so that once they are empty, only the reservoir and not the entire printhead need be replaced ("refillable" heads).

In short, while adhering to the principle of this invention, details of the design and the forms of embodiment described and illustrated in the foregoing may be amply modified, without exiting from the scope of the invention.

What is claimed is:

1. A method for stabilizing the thermal working conditions of an ink jet printhead comprising the steps of:

providing a printhead including at least one ejection resistor integrated on a semiconductor substrate for ejecting droplets of ink, and at least one second resistor integrated on said substrate for heating said substrate, said at least one second resistor having a resistance value variable according to a temperature of said substrate;

providing first energy supplying means selectively commandable for supplying energy to said at least one second resistor according to a sequence of cycles comprising a first step of supplying said energy for a first time of variable duration, followed by a second step of not supplying said energy for a second time of constant, determined duration;

providing an electronic device including a differential amplifier circuit and a monostable univibrator circuit, said differential amplifier circuit having a first input connected to a reference voltage of determined value of between a minimum voltage and a maximum voltage, and a second input connected to a second voltage of variable value, said variable value being proportional to said resistance value of said at least one second resistor, said determined value of said reference voltage being defined by a setting process comprising the steps of:

bringing said value of said reference voltage to said maximum voltage, so that said first time of variable duration is substantially null, gradually reducing said value of said reference voltage with respect to said maximum voltage to a first voltage value, at which said first time of variable duration is no longer substantially null, assuming said first voltage value as said determined value of said reference voltage.

2. A method for automatically setting the energetic operating point of ejection resistors of an ink jet printhead, said printhead including:

a semiconductor substrate on which said ejection resistors are integrated;

at least one additional resistor integrated on said substrate for heating of said substrate having a resistance value variable according to a temperature of said substrate;

first energy supplying means for selectively supplying energy to said additional resistor, said method comprising:

providing command means for commanding said first energy supplying means according to a sequence of cycles comprising a first step of supplying said energy for a first time of variable duration, followed by a second step of not supplying said energy having a second time of constant, determined duration, providing second energy supplying means for selectively supplying to said ejection resistors a working energy variable between a maximum energy value and zero, stabilizing said temperature of said substrate by way of said command means, supplying to said ejection resistors said working energy of a value equivalent to said maximum energy value, so that said value of said first time of variable duration decreases to a minimum time value, gradually decreasing said working energy supplied to said ejection resistors with respect to said maximum energy value, so that said first time of variable duration increases with respect to said minimum time value, gradually further decreasing said working energy supplied to said ejection resistors until a first energy value is reached, such that said first time of variable duration stops increasing and instead starts to decrease, assuming as the value for said working energy to be supplied to said ejection resistors said first energy value incremented by a defined amount.

3. A method according to claim 1 or 2, in which said at least one second resistor is constituted by a material having a positive coefficient of variation of resistance with temperature with a value between 0.3 and 1.0%/°C.

4. A method according to claim 1 or 2, in which said at least one second resistor is constituted by a material selected from a group consisting of copper, aluminium, and aluminium/copper alloys.

5. A method according to claim 1 or 2, in which said first energy supplying means comprise at least one MOS transistor integrated on said semiconductor substrate.

6. A method according to claim 1, further comprising the steps of:

measuring an ambient temperature value, correlating said first voltage value of said reference voltage with said ambient temperature value for defining said determined value of said reference voltage.

7. A method according to claim 1 or 2, further comprising the step of automatically setting the energetic operating point of said at least one ejection resistor.

8. A method according to claim 7, wherein said automatically setting step comprises the steps of:

providing second energy supplying means for selectively supplying to said at least one ejection resistor a working energy variable between a maximum energy value and zero, supplying to said at least one ejection resistor said working energy of a value equivalent to said maximum energy value, so that said value of said first time of variable duration decreases to a minimum time value, gradually decreasing said working energy supplied to said at least one ejection resistor with respect to said maximum energy value, so that said value of said first time of variable duration increases with respect to said minimum time value, gradually further decreasing said working energy supplied to said at least one ejection resistor until a first energy value is reached, such that said value of said first time of variable duration stops increasing and instead starts to decrease, assuming as the value for said working energy to be supplied to said at least one ejection resistor said first energy value incremented by a defined amount.

9. A method according to claim 8, wherein said defined amount is between 2% and 50% of said first energy value.

10. A method according to claim 2, wherein said defined amount is between 2% and 50% of said first energy value.

* * * * *